United States Patent [19]

Green

[11] Patent Number: 5,069,230

[45] Date of Patent: Dec. 3, 1991

[54] SMOKE GENERATING APPARATUS

[76] Inventor: William D. Green, 8906 Camden St., Alexandria, Va. 22308

[21] Appl. No.: 848,632

[22] Filed: Apr. 7, 1986

Related U.S. Application Data

[63] Continuation-in-part of Ser. No. 588,363, Mar. 12, 1984, Pat. No. 4,580,583, which is a continuation-in-part of Ser. No. 251,074, Apr. 6, 1981, Pat. No. 4,436,100, and a continuation-in-part of Ser. No. 104,701, Dec. 17, 1979, Pat. No. 4,259,970.

[51] Int. Cl.[5] ..... A24F 47/00

[52] U.S. Cl. ..... 131/330; 131/185; 446/24

[58] Field of Search ..... 131/300, 329, 185; 446/24

[56] References Cited

U.S. PATENT DOCUMENTS

| | | |
|---|---|---|
| 1,174,088 | 3/1916 | Mullock . |
| 2,960,981 | 11/1960 | Robertson . |
| 3,785,304 | 1/1974 | Stookey . |
| 3,804,104 | 4/1974 | Fariello . |
| 3,889,690 | 6/1975 | Guarnieri . |
| 4,164,230 | 8/1979 | Pearlman . |
| 4,259,970 | 4/1981 | Green . |
| 4,270,464 | 6/1981 | Keres . |
| 4,436,100 | 3/1984 | Green . |

*Primary Examiner*—V. Millin

[57] ABSTRACT

An annular wall extending from a bottom wall foundation of a rotating burner assembly encloses a combustion zone into which combustible material is fed. An energized heating element mounted on an internally concave, heat insulating surface of the annular wall has the combustible material accumulated thereon during rotation to generate smoke upwardly withdrawn from the combustion zone.

35 Claims, 5 Drawing Sheets

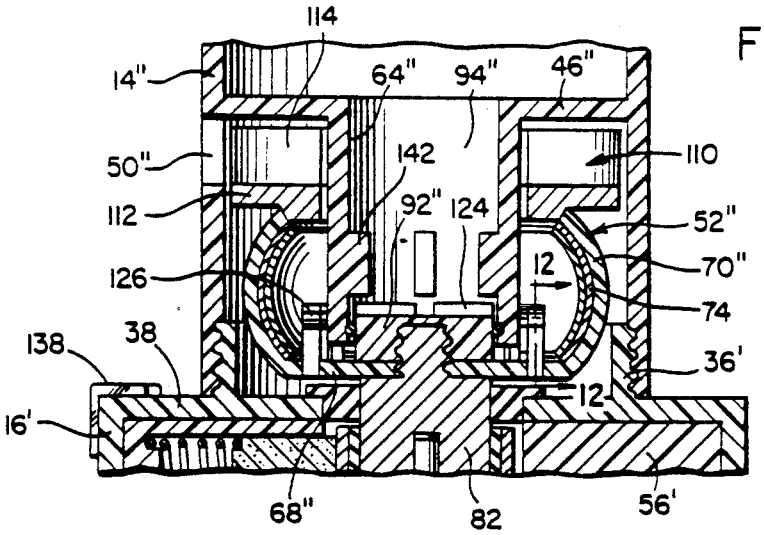
FIG. 11
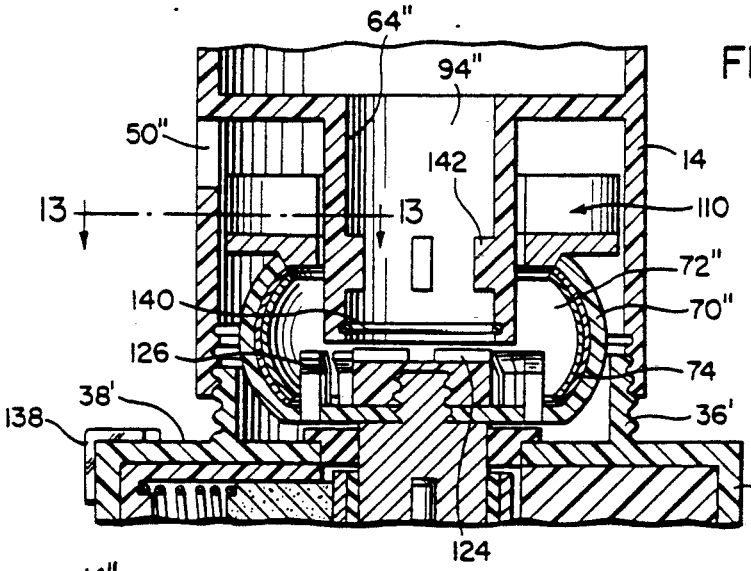
FIG. 11A
FIG. 13
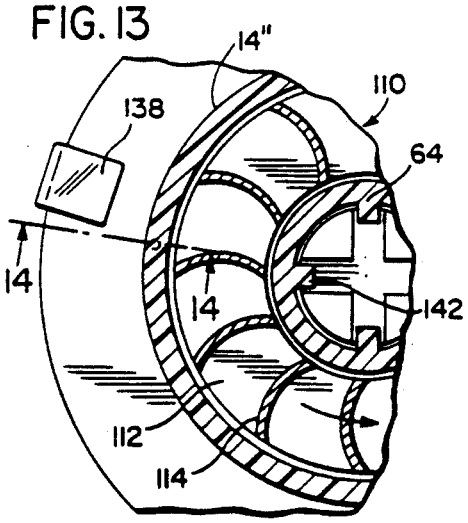
FIG. 12
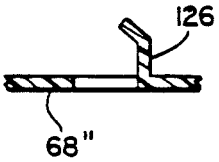
FIG. 14
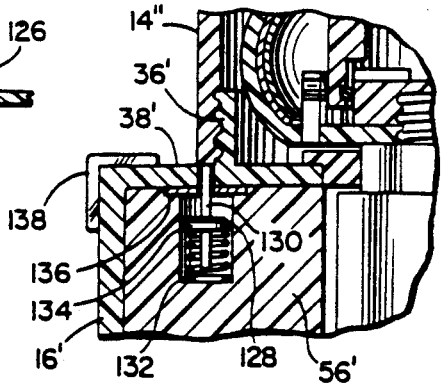

SMOKE GENERATING APPARATUS

BACKGROUND OF THE INVENTION

This invention relates generally to the generation and dispensing of smoke by apparatus and this application is a continuation-in-part of Ser. No. 588,363, filed Mar. 12, 1984, now U.S. Pat. No. 4,580,583 which is in turn a continuation-in-part of Ser. No. 251,074, filed Apr. 6, 1981, now U.S. Pat. No. 4,436,100 which is in turn a continuation-in-part of Ser. No. 104,701, filed Dec. 17, 1979, now U.S. Pat. No. 4,259,970.

The smoke generation as disclosed in all of my prior copending applications involve combustion of solid material within a combustion zone located on the upstream side of a screen element through which smoke passes and is thereby filtered. Only in one of two embodiments disclosed in U.S. Pat. No. 4,580,583, is the combustion zone located on the downstream side of the screen. A disadvantage suffered by such apparatus is the unintended escape from the combustion zone of combustible material escape from the combustion zone of combustible material prior to combustion.

According to all embodiments as disclosed and claimed prior U.S. Pat. No. 4,580,583, the combustion zone is enclosed within a rotatable rotor having an annular wall on which an electrical heating element is internally mounted, and to which impeller blades are fixed for inducing outflow of smoke from the combustion zone. In one embodiment, the impeller blades are integrally formed on the top of the rotor so as to exhaust smoke upwardly from the combustion zone. Commutator elements are therefore mounted on the bottom wall of the rotor for establishing electrical connections, through brushes, to the heating element, the brushes projecting through openings in a partition housing wall separating the drive motor from the rotor. Also in such embodiment, comminuted material may be withdrawn from the combination zone during the infeed loading operation by forced flow resulting in a loss of combustible material. The foregoing arrangements also have certain disadvantages because of manufacturing difficulties and costs as well as operational problems.

It is therefore an important object of the present invention to provide a rotatable burner assembly which avoids the drawbacks aforementioned in connection with the apparatus disclosed and claimed in my prior patents including unintended escape of combustible material during loading and combustion stages, from the combustion zone.

A further object is to provide a rotatable burner assembly for smoke generators which is more readily disassembled for cleaning and maintenance purposes.

Yet another object is to provide a rotatable burner capable of being assembled in various configurations to fulfill different smoke generating requirements.

SUMMARY OF THE INVENTION

In accordance with the present invention, the burner assembly is a rotor formed by an annular wall having an internally concave, heat insulating surface on which an electrical heating element is mounted above a lower supporting wall to which the annular wall is connected. The lower wall is centrally clamped to a cylindrical drive member on which slip rings are mounted for establishing electrical connections between the heating element and a source of energy during rotation of the burner by a drive motor connected to the drive member. The concave annular wall encloses a combustion zone above the lower wall from which combustion products or smoke thermally rise for exhaust from an axial passage formed at the upper axial end of the annular wall. Combustible material is fed into the combustion zone through the axial passage in countercurrent relation to the smoke exhaust.

According to certain embodiments of the invention in which exhaust of smoke is enhanced by forced flow, a bladed blower section is attached to the upper axial end of the annular wall forming the axial exhaust passage from which the smoke is directed radially by impeller blades during rotation of the burner assembly. In other embodiments, the infeeding combustible material is accumulated on the heating element of the rotatable burner assembly under inducement of impeller blades within the combustion zone. The concave curvature of the heating element and the annular wall on which it is mounted, cause the accumulation material to be concentrated at a location at which the curvature is tangent to the gravitational vertical. Where the combustible material is to be comminuted, passage dividing vanes in the infeed tube are formed with cutting edges at their lower ends closely spaced from the slotted surface of an upwardly converging conical member clamping the lower wall to the drive member for rotation of the burner assembly.

According to other embodiments, the combustible material is fed into the combustion chamber from a receiving well through infeed ports. The infeed of material is manually controlled by opening and closing the infeed ports by means of an angularly displaceable member on the bottom of a hopper within which a quantity of the combustible material may be stored.

The burner assembly in some embodiments is enclosed within one chamber of a housing separated by a partition wall from a lower chamber within which the drive motor is positioned by a spacer formed with radial bores slidably mounting spring biased brushes in wiping contact with the slip rings on the drive member projecting axially into the lower chamber from the burner assembly. Control switches are mounted on the housing to control energization of the drive motor and the heating element from a common power source in accordance with circuit arrangements generally well known in the art.

Where a hopper is utilized, the housing is vertically extended to enclose a top loaded hopper chamber separated by another partition wall from the burner chamber. Both the hopper and burner chambers are vented and an outlet opening is formed in the burner chamber in alignment with the bladed blower section so as to discharge an outflow of smoke induced by rotation of the burner assembly. The outlet opening according to one embodiment is enclosed by the closed end portion of a duct externally mounted on the hopper portion of the housing. The duct extends angularly about the housing in an upwardly inclined direction toward an open smoke discharge end.

In other embodiments of the invention, the infeed tube is axially adjustable between a material loading position and an operational smoke generating position. In the loading position registered by illumination of an indicator lamp, the lower end of the infeed tube is axially spaced from agitator blades on a nut clamping the lower wall of the rotatable burner assembly so as to impel material radially outward into the combustion chamber as the rotor rotates. Also, in the loading position the outlet port is out of alignment with the impeller blades of the blower section to disable its discharge action. The material fed into the combustion zone will be impelled by centrifugal force radially outward onto the heating element as aforementioned during a loading operation while the burner element is de-energized. During the smoke generating operations, the material comminuting and smoke discharge actions occur as the burner element is energized. Comminution of material is however confined by a sealing element to the infeed passage during the smoke generating operation so as to prepare material for a subsequent loading operation.

BRIEF DESCRIPTION OF DRAWING FIGURES

Various embodiments of the invention are hereinafter described in greater detail with reference to the accompanying drawings, in which.

Figure 1:
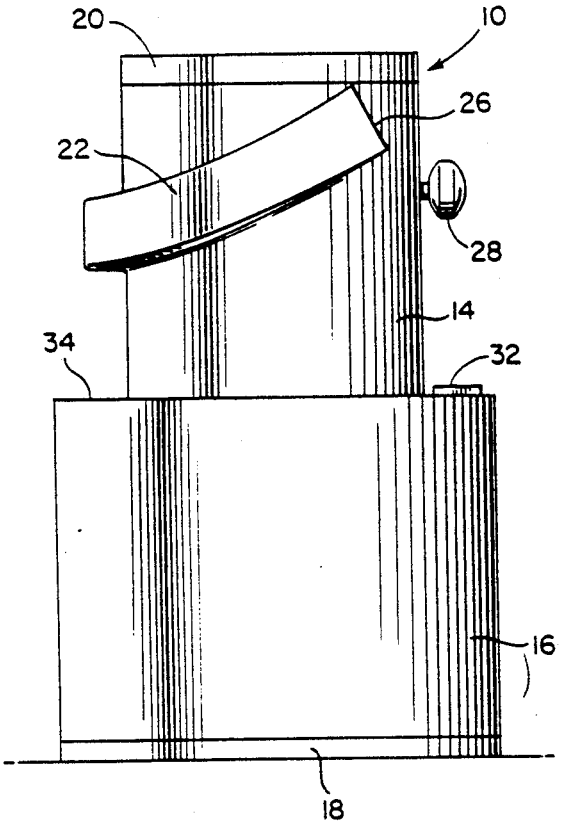
FIG. 1 is a side elevation view of a smoke generating apparatus in accordance with one embodiment of the invention.
Figure 15:
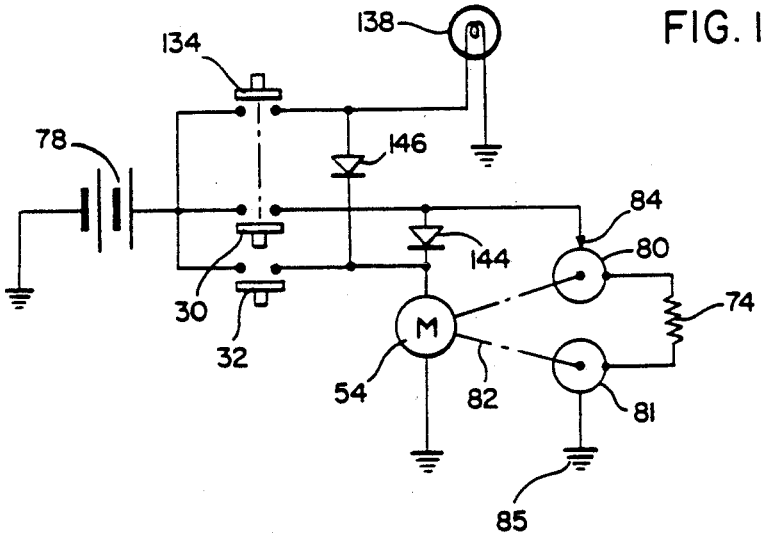
Figure 3:
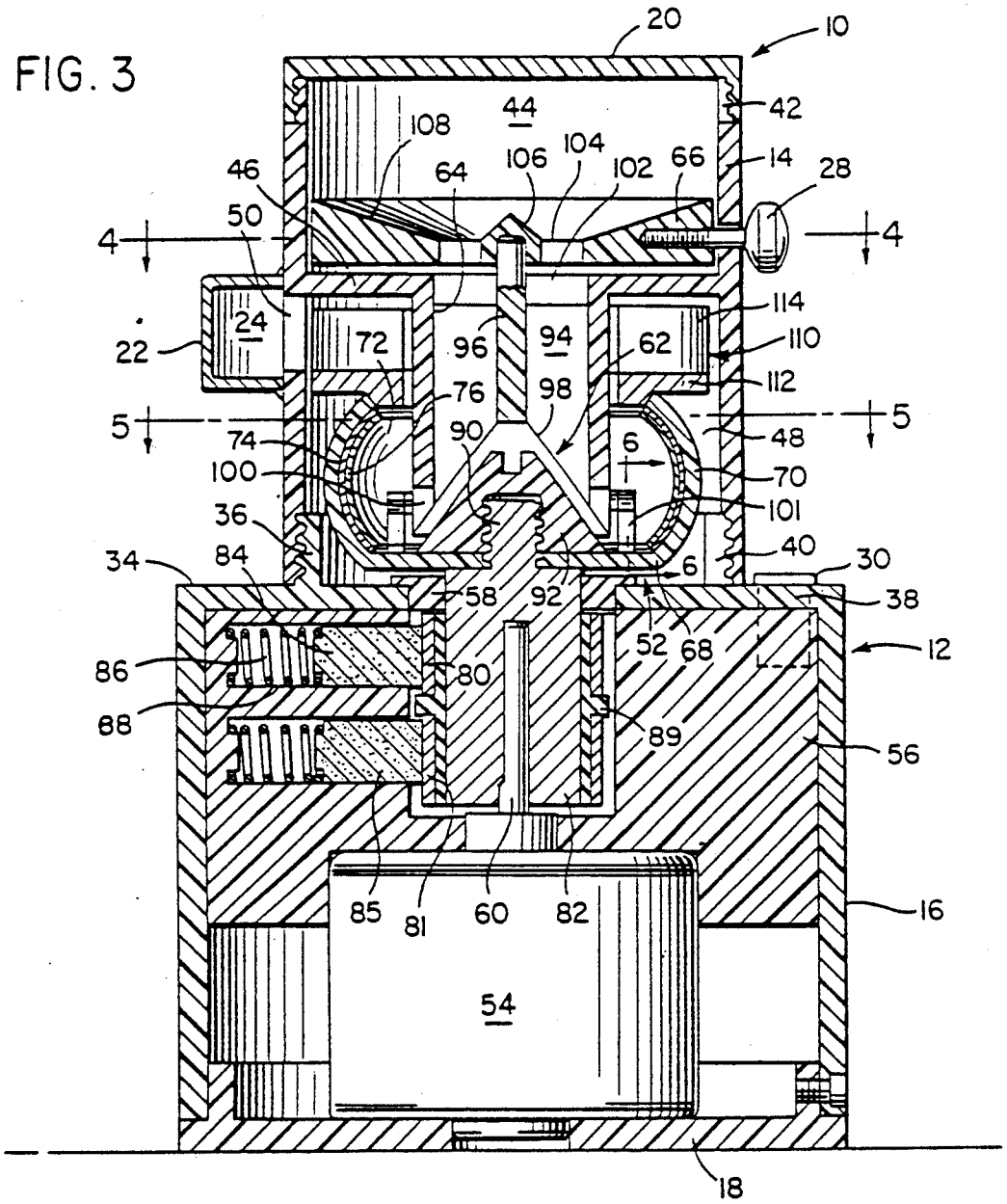
FIG. 3 is a side section view taken through a plane indicated by section line 3—3 in FIG. 2.
Figure 6:
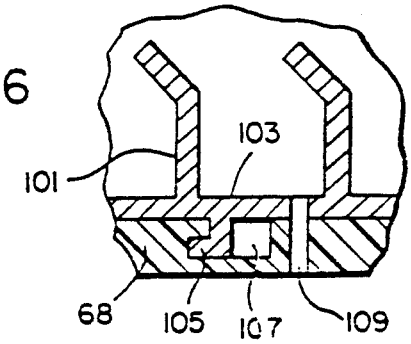
Figure 4:
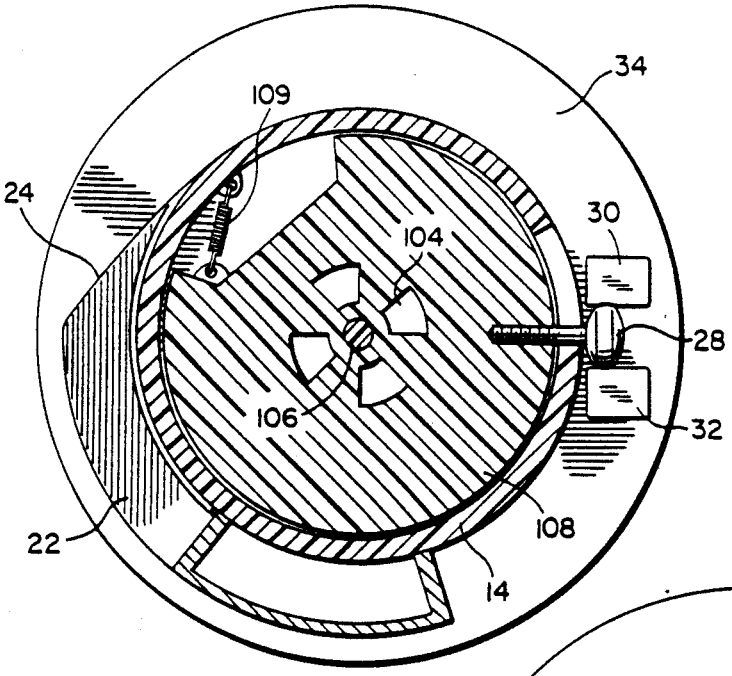
Figure 5:
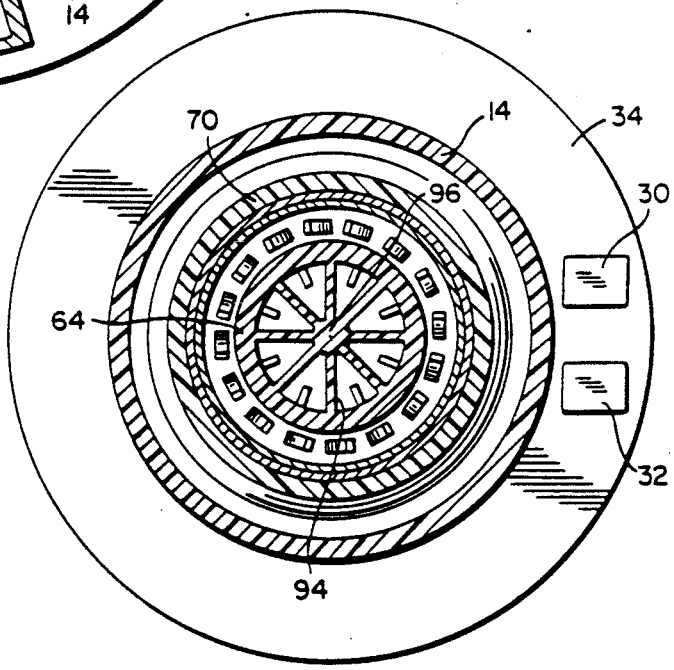
Figure 10:
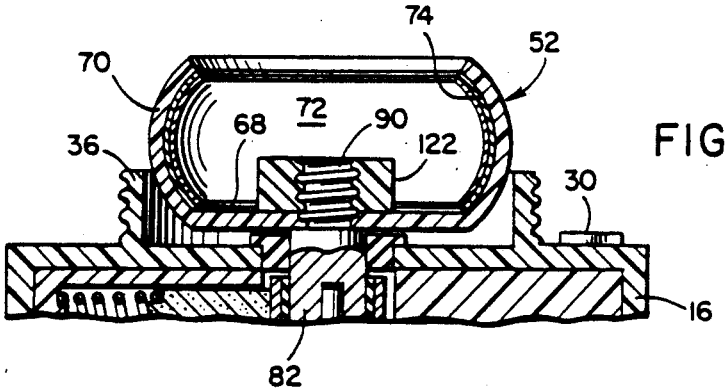
Figure 7:
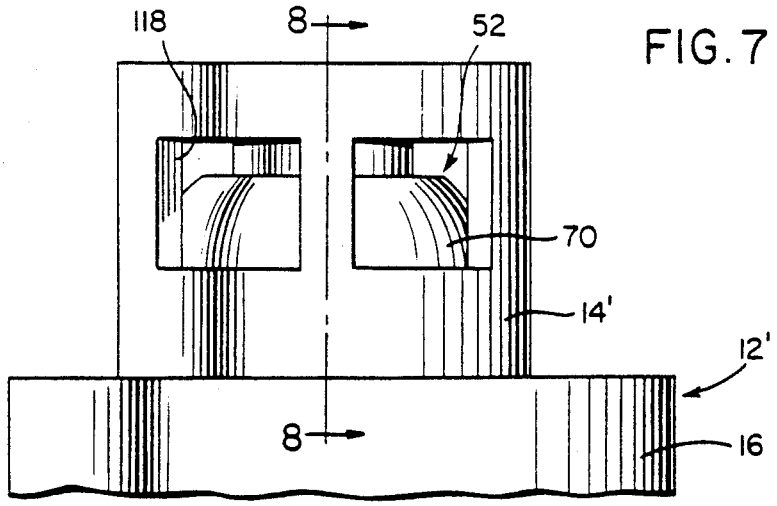
Figure 8:
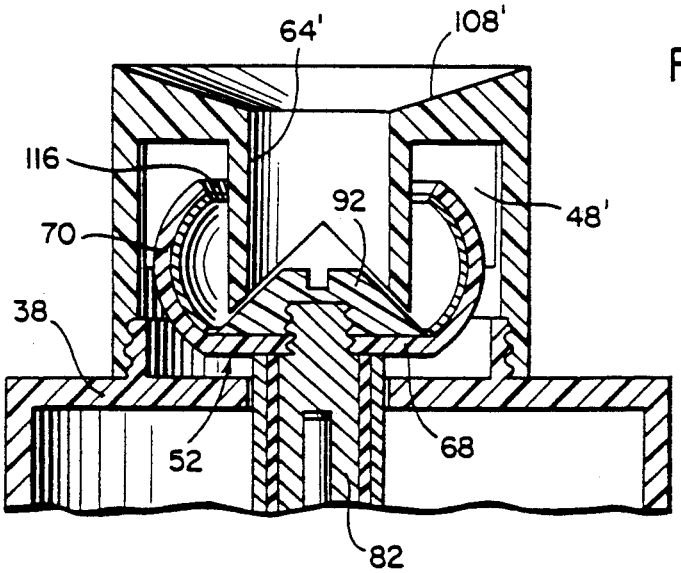
Figure 9:
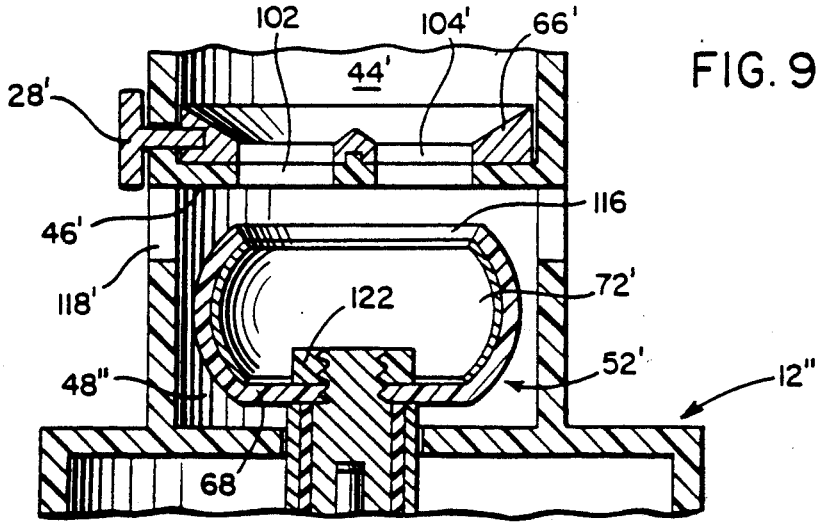

FIGS. 4 and 5 are top section views taken through planes indicated by section lines 4—4 and 5—5 in FIGS. 1 and 3, respectively;

FIG. 6 is a partial section view taken substantially through a plane indicated by section line 6—6 in FIG. 3;

FIG. 7 is a partial side elevation view of a modified apparatus in accordance with another embodiment of the invention;

FIG. 8 is a section view taken through a plane indicated by section line 8—8 in FIG. 7;

FIG. 9 is a partial side section view showing a modification in accordance with yet another embodiment;

FIG. 10 is a partial side section view of a basic form of the invention for use with any comminuer or blower section;

FIG. 11 is a partial side section view of yet another embodiment of the invention, in a smoke generating condition;

FIG. 11A is a partial side section view similar to FIG. 11 showing the apparatus in a material loading condition;

FIG. 12 is an enlarged partial section view taken substantially through a plane indicated by section line 12—12 in FIG. 11;

FIG. 13 is a partial section view taken substantially through a plane indicated by section line 13—13 in FIG. 11A;

FIG. 14 is a partial section view taken substantially through a plane indicated by section line 14—14 in FIG. 13; and FIG. 15 is an electrical circuit diagram showing a control system for the apparatus.

DETAILED DESCRIPTION OF PREFERRED EMBODIMENTS

Figure 2:
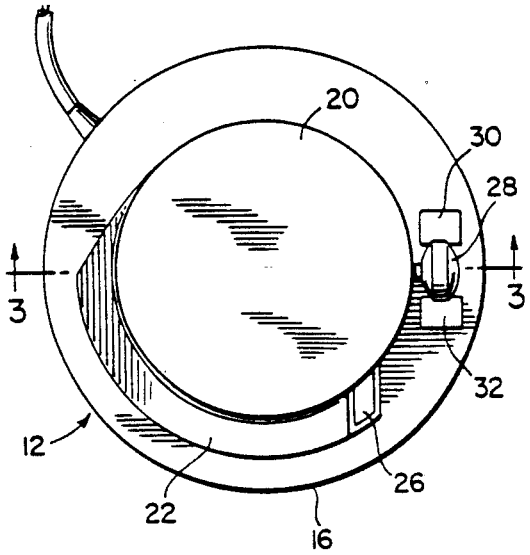
FIG. 2 is a top plan view of the apparatus shown in FIG. 1.

Referring now to the drawings in detail, FIGS. 1-6 illustrate a smoke generating apparatus constructed in accordance with one specific embodiment generally referred to by reference number 10. In this embodiment, the apparatus is enclosed by a housing assembly 12 formed by an upper cylindrical housing section 14 of a smaller diameter and a lower cylindrical housing section 16 of a larger diameter. The housing assembly is closed at its lower axial end by a circular bottom 18 and at its upper axial end by a circuit cover 20 which is removable for top loading purposes. As shown in FIGS. 1 and 2, a duct 22 is mounted externally on the upper housing section 14. The duct 22 conforms to the external cylindrical curvature of the housing section 14, extending at an angle from a closed end 24, intermediate the axial ends of the housing section, to an open smoke discharge end 26 at the upper axial end. An angularly displaceable, feed control arm 28 projects from one side of the upper housing section while a pair of push button controls switches 30 and 32 are mounted below the knob 28 on an annular shoulder 34 formed between the housing sections. The switches 30 and 32 control operation of the apparatus as will be explained in detail hereinafter.

As more clearly seen in FIG. 3, the upper housing section 14 is threadly connected to the lower housing section by means of an externally threaded annular formation 36 on its upper partition wall 38. An air vent opening 40 formed in formation 36 is exposed by threadedly raising the housing section 14 relative to the lower housing section 16. The upper axial end portion of housing section 14 is threadedly connected to the cover 20 which is raised by threaded rotation to expose an opening 42 formed in the annular portion to the cover to vent a hopper chamber 44 enclosed within housing section 14 above another housing partition wall 46 in the embodiment shown. The hopper chamber thus stores combustible material therein separated from a lower burner chamber 48 below the partition wall 46, vented through the air vent 40. The closed end portion 24 of duct 22 is aligned with a smoke outlet port 50 formed in the housing section 14 just below the partition wall 46. The duct 22 will accordingly conduct smoke toward its discharge opening 26 in heat conductive relation to the hopper chamber 44 and discharge the smoke in an upwardly inclined direction.

The basic smoke generating burner component of apparatus 10 is enclosed within the vented burner chamber 48, in the form of a rotor assembly generally referred to by reference numeral 52 as shown in FIG. 3. The rotor assembly is driven by an electric motor 54 supported on the bottom 18 of the housing within the lower housing section 16. An annular spacer 56 abutting the upper wall 38 of the lower housing section positions the motor 54 in operative alignment with a central seal bearing 58 in wall 38 through which the rotor assembly extends for connection to the motor shaft 60 projecting upwardly from the motor. Also enclosed within the burner chamber 48 in the embodiment shown in FIG. 3, is material comminuting means 62 associated with an infeed passage tube 64 projecting downwardly from partition wall 46 into the rotor assembly 52. The infeed tube 64 is axially aligned with an angularly adjustable feed rate control member 66 at the lower end of the hopper chamber 44 to which the control arm 28 is connected for regulating the infeed rate of combustible material as will be explained in greater detail hereinafter.

The rotor assembly 52 includes a lower wall formation or support 68 in the form of a horizontal, circular disc formed integrally with an annular wall 70 about its periphery. The support 68 and annular wall 70 encloses a combustion zone or chamber 72 open at its upper axial end through which the infeed tube 64 projects. The annular wall is concave is concave in cross-section and mounts an electrical heating element 74 conforming to the concave curvature of the annular wall. A non-stick coating 76 is applied to the heating element to avoid adhesion of combustible particles thereto and facilitate removal of combustion residues. The annular wall 70 is made of suitable material to maintain its structural integrity and reflect heat from its internal concave surface toward heating element 74. The heating element and the motor 54 are energized from a common source of electrical energy 78 under control of the switches 30 and 32 as shown in FIG. 15.

The electrical power source 78 is electrically connected through switch 30 to the heating element 74 by means of current conducting slip rings 80 and 81 mounted on a cylindrical drive member 82 to which the motor shaft 60 is keyed, as shown in FIG. 3, for imparting rotation to the rotor assembly when motor 54 is energized by actuation of switch 32. The slip rings are in wiping contact with brushes 84 and 85 under the bias of coil springs 86 mounted within radial bores 88 formed in the spacer 56. The electrical connection between the switch 30 on the stationary housing 12 and the heating element 74 rotatable with the rotor assembly is thereby established. An insulating ring 89 separates the slip rings 80 and 81 on the drive member 82.

The drive member 82 is clamped to the support 68 as shown in FIG. 3 by a threaded shank 90 internally threaded into a slotted conical member 92 forming part of the material comminuting means 62, aforementioned. The slotted conical surface of member 92 centrally located within the combustion zone 72, is closely spaced from the ends of passage dividing vanes 94 interconnecting the infeed passage tube 64 with a central post 96. The lower ends of the vanes 94 form stationary cutting edges 98 closely spaced from the conical surface of member 92 onto which solid combustible material is deposited through passages between the vanes 94 in the infeed tube 64. The combustible material is thereby ground or comminuted in response to rotation of the slotted conical surface member 92 with the rotor assembly, and the comminuted material is discharged into the combustion zone through slots 100 formed at the lower end portion of the infeed tube 64 for dispersal radially outward by impeller blades 101 into contact with heating element 74 and held thereon by centrifugal force.

As shown in FIG. 6, the impeller blades 101 project upwardly into the combustion zone 72 from an annular ring 103 secured to the support 68 by lugs 105 received in slots 107 formed in support 68 so as to rotate therewith in one direction. Vent openings 109 are formed in the support 68 as shown.

The vane divided passages in the infeed tube 64 are in communication with the hopper chamber 44 through sector shaped infeed ports 102 at the upper end of the infeed tube and openings 104 in the angularly adjustable member 66. The member 66 has a central hub portion 106 journaled on the upper end of post 96 and a top conical surface 108 forming a receiving well converging downwardly toward the openings 104. The infeed of material is regulated by limited angular displacement of member 66 through control arm 28 from a feed blocking position against the bias of a spring 109 as shown in FIG. 4 to a fully open position in which the openings 104 are aligned with ports 102.

Combustion of the comminuted material accumulated on the heating element 74 by the heat generated there at produces combustion products or smoke which rise by thermal inducement for exhaust from the upper axial end of the annular wall 70 forming an exhaust passage externally of the infeed tube 64. The smoke is thereby conducted in countercurrent heat conductive relation to the infeeding material for preheating thereof prior to combustion.

In the embodiment shown in FIG. 3, flow of smoke being exhaused downstream of the combustion zone is positively induced by a bladed blower section 110 of the rotor assembly. The blower section is fixed by its annular hub portion 112 to the upper axial end of the annular wall 70 to form an axial outflow passage about the infeed tube 64. Radially extending impeller blades 114 of the blower section are aligned with the axial plane of outlet opening 50 through which the smoke is centrifugally discharged into the duct 22 upon rotation of the rotor assembly.

From the foregoing description, it will be apparent that the cover 20 is threadedly removed for top loading of combustible material into the hopper chamber 44. By closing of switch 30, the heating element 74 is energized by current transmitted through the brushes 84 and 85 and slip rings 80 and 81 to cause burning of combustible material within zone 72 producing smoke which thermally rise for exhaust from the upper end of the annular wall 70 enclosing the zone 72. Heat generated by element 74 is concentrated or focused by the concave curvature of the annular wall 70 toward the central location in the combustion zone from which material infeed originates. Energization of the motor 54 is controlled independently of the heating element 74 through switch 32 to rotate the burner assembly 52, operate the material comminuting means 62 and operate the flow inducing bladed blower section 110 as hereinbefore described.

The same burner assembly 52 as hereinbefore described with respect to FIGS. 1–6 may also be associated with a simplified version of the smoke generating apparatus as shown in FIGS. 7 and 8, having no hopper or blower. In this embodiment the smoke generated in combustion zone 72 as hereinbefore described is also exhausted from the upper open end 116 of annular wall 70 into a burner chamber 48' enclosed by an upper housing section 14' of a housing 12'. The smoke is discharged from openings 118 in housing section 14', while combustible material is introduced through an infeed tube 64' from a fixed conical receiving well 120 formed on the top of the housing section 14'. The combustible material is communited between the conical member 92 and the lower edges of the infeed tube 64' as hereinbefore described with respect to the comminutor 62 shown in FIG. 3.

FIG. 9 shows yet another modification or simplified version of the apparatus in which a housing 12'' has an upper section 14'' with smoke discharge openings 118' formed therein. In this embodiment the blower section as well as the communitor are omitted, but an infeed rate regulator is provided in the form of an angularly adjustable member 66'. The member 66' is positioned at the lower end of a hopper chamber 44' adapted to be loaded with combustible material already in particulate form. The member 66' is provided with openings 104' adjustably aligned with infeed ports 102' in the wall 46' at the bottom of the hopper chamber by manipulation of control arm 28'. Material is thereby dropped at an adjusted infeed rate into the combustion chamber 72' through the upper axial end 116 formed by the annular wall 70 of a modified rotor assembly 52'. The support 68 of the rotor assembly 52' is clamped to the upper end of the drive member 82 by nut 122. Smoke generated in burner zone 72' will be exhausted into housing camber 48" from the open exhaust end 116 and discharged from the housing through openings 118'.

Operation of the modified versions of the apparatus respectively shown in FIGS. 8 and 9 is the same as that of FIGS. 1-6 in so far as the common rotatable burner assembly is concerned. It will therebore be apparent that such common burner assembly may be used with different combinations of ducts, blowers, communicators, hoppers, and infeed rate adjusting mechanism to suit different economic, consumer or installational requirement. The combinations illustrated in FIGS. 8 and 9 are only examples of the configurations that are possible.

FIG. 10 shows use of the a basic smoke generating apparatus conforming generally to FIGS. 1-6 without the upper housing section 14. A burner rotor assembly 52" is thus exposed and may be top loaded directly with combustible material. A nut 122 holds the bottom support 68 clamped to the upper end of the drive member 82. Energization of burner element 74 on the concave wall 70 will generate smoke by combustion of the material in chamber 72, and the smoke will be discharged from the upper open end of assembly 52".

In FIG. 11, a modified form of burner assembly 52" is shown having a blower section 110 associated therewith as described with respect to FIG. 3. The bottom support 68" of the burner assembly is clamped to drive member 82 by a nut 92" having agitator blades 124 projecting upwardly therefrom. A plurality of air and material impeller blades 126 are struck out of the bottom support 68" as more clearly seen in FIG. 12. The blades 126 are spaced radially outward of the blades 124 and project upwardly into the combustion chamber 72" closely spaced from an infeed tube 64". The annular concave wall 70" to which the blow hub 112 is connected, is in surrounding relation to the infeed tube 64" which depends from partition wall 46" of a housing section 14" enclosing a receiving well 108' above the partition wall. The housing section 14" is threadedly connected to the externally threaded formation 36' on the lower housing section 16' and is axially adjusted between a loading position shown in FIG. 11A and a smoke generating position shown in FIG. 11. A spacer 56' within the housing section 16' is formed with a vertical bore 128 as shown in FIG. 14 slidably mounting a plunger 130 projecting upwardly through partition wall 38' into contact with the lower end of housing section 14", under the bias of spring 132. Thus, in the loading position of the housing section 14" the plunger contact 134 engages the fixed contacts 136 to complete an energizing circuit through an indicator lamp 138. The indicator lamp 138 is mounted on the housing section 16' at a suitable location to signify when the housing section 14" has been elevated to its loading position.

In the lowered smoke generating position of housing section 14", its outlet port 50" is aligned with the impeller blades 114 of the blower section having curvat ures as shown in FIG. 13 for radial displacement of smoke in an optimum direction for discharge with minimal turbulence of flow losses. In the upper loading position, the outlet port 50" is out of alignment with the blower section so that blower discharge is blocked.

Adjacent the lower end of the infeed tube 64", an annular wiping seal element 140 is seated for sealing contact with the radially outer surface of nut 92". Passage 94" in the tube 64" will thereby be sealed from the combustion chamber 72" in the smoke generating position shown in FIG. 11. In this position of the infeed tube, the rotatable agitator blades 124 on nut 92" are close to the lower edges of internal projections 130 fixed to the infeed tube. Rotation of the burner assembly will therefore produce a comminuting action with tube passage 94" between agitator blades 124 and fixed projections 142. In the loading position of the infeed tube as shown in FIG. 11A, there is no communicating action because of the greater axial spacing between blades 124 and projections 142. However, blades 124 do function as material agitators in dispersing material entering the combustion chamber 72" from the lower end of the infeed tube.

It will be apparent from the foregoing description of FIGS. 11, 11A, 12 and 13 that material infeed is enhanced by both blades 124 and 126 in the loading position of the infeed tube to accumulate a desired quantity of comminuted material in the combustion chamber without burning. Only the drive motor is energized during such loading operation while discharge of material by the blower section is blocked. When the infeed tube is lowered to its other position as shown in FIG. 11, infeed is blocked by seal element 140 and a communicating action is initiated confined to passage 94". By energization of burner element 74, previously loaded material in chamber 72" undergoes combustion enhanced by the centrifugal action on the material pressing against the heating element.

In all of the embodiments described, the combustible material entering the combustion zone is impelled radially outward toward the annular wall of the rotating burner assembly, on which the heating element 74 is mounted. The concave curvature of the annular wall will cause the material accumulating on the heating element to be concentrated at a location at which the all curvature is tangent to the gravitational vertical, spaced thereby from both the bottom and the upper outlet end of the combustion zone.

As shown in FIG. 15, the common source of electrical energy 78 is connected in parallel to the heating element 74 and the motor 54 through switches 30 and 32, respectively. Closing of switch 30 will also energize motor 54 through diode 144 so as to insure that the burner assembly is rotating during any combustion operation. Switch 30 is however interconnected with the switch 134 (shown in FIG. 14) so as to be opened to prevent energization of the heating element during a loading operation while the indicator lamp 138 is illuminated by closing of switch 134. The motor 54 is energized during the loading operation through diode 146.

Having thus described certain embodiments of the invention in detail, it will be understood that various changes and modifications may suggest themselves to persons skilled in the art, all falling within the scope of the invention as defined by the appended claims.

What is claimed is:

1. In a smoke generating apparatus, including a housing having an outlet opening formed therein, and a combustion chamber therebelow, infeed means for gravitationally conducting combustible material into the combustion chamber and a rotatable burner assembly, comprising a supporting wall spaced below the infeed means, an annular wall projecting upwardly from the supporting wall in enclosing relation to the combustion chamber, heat emitting means mounted on the annular wall internally of the combustion chamber for combustion of the material accumulated thereon and means responsive to rotation of the burner assembly for radially impelling the material fed into the combustion chamber toward the annular wall to accumulate the material on said heat emitting means.

2. The burner assembly as defined in claim 1 wherein the annular wall has an internally concave heat reflective surface.

3. The burner assembly as defined in claim 2 wherein the heat emitting means is an electrically energized element conforming to the internally concave surface of annular wall.

4. The burner assembly as defined in claim 3 including slip-ring means electrically connected to the electrically energized element for supply of electrical energy thereto.

5. The burner assembly as defined in claim 4 including bladed blower means fixed to the annular wall within the exhaust passage for inducing outflow of the smoke from the combustion chamber.

6. The apparatus as defined in claim 5 including a comminutor device mounted within the combustion chamber in operative relation to the infeed means for physically reducing the combustible material to particle size.

7. The apparatus as defined in claim 6 wherein the comminutor device includes a slotted conical member fixed to and projecting from the supporting wall and cutting edge means fixed to the infeed means in operatively spaced relation to the conical member for grinding the combustible material in response to rotation of the burner assembly.

8. The apparatus as defined in claim 7 wherein the infeed means includes a feed passage tube and axially elongated vanes extending through the feed passage tube in coaxial relation to the exhaust passage, the cutting edge means being formed on lower ends of the vanes.

9. The apparatus as defined in claim 1 including bladed blower means fixed to the annular wall within the exhaust passage for inducing outflow of the smoke from the combustion chamber.

10. The apparatus as defined in claim 1 including a communitor device mounted within the combustion chamber in operative relation to the infeed means for physically reducing the combustible material to particle size.

11. The apparatus as defined in claim 10 wherein the communicator device includes a conical member fixed to and projecting from the bed support and cutting edges means fixed to the infeed means in operatively spaced relation to the conical member for grinding the combustible material in response to rotation of the burner assembly.

12. The apparatus as defined in claim 11 wherein the infeed means includes a feed passage tube and axially elongated vanes extending through the feed passage tube in coaxial relation to the exhaust passage, the cutting edge means being formed on lower ends of the vanes.

13. In a combustion apparatus, a rotor assembly comprising an annular heat reflective wall enclosing a combustion zone between opposite axial ends thereof, a supporting wall fixed to the annular wall at one of said axial end, a drive shaft connected to the supporting wall through which rotation is imparted to the annular wall, passage means extending into the combustion zone at the other of said ends of the annular wall for conducting an infeed of the combustible material and exhaust of combustion products in counter-current relation to each other, and heat generating means mounted internally on the annular wall for combustion of the material accumulating thereon.

14. The rotor assembly as defined in claim 13, including slip-ring means mounted on the drive shaft and electrically connected to the heat generating means for supply of electrical energy thereto.

15. The rotor assembly as defined in claim 14 including bladed blower means connected to the annular wall at said other of the ends thereof for inducing outflow of the combustion products through the passage means.

16. The rotor assembly as defined in claim 15 wherein the annular wall has a concave curvature to substantially concentrate the material accumulated on the heat generating means at a location of tangency between said curvature and a gravitational vertical.

17. The rotor assembly as defined in claim 13 including bladed blower means connected to the annular wall at said other of the ends thereof for inducing outflow of the combustion products through the passage means.

18. The rotor assembly as defined in claim 13 wherein the annular wall has concave curvature to substantially concentrate the material on the heat generating means within the combustion zone at a location of tangency between the curvature and a gravitational vertical.

19. In a smoke generating apparatus including a housing having a combustion chamber therein, infeed passage means for conducting combustible material into the combustion chamber and heat generating means for combustion of the material within the combustion chamber, the improvement residing in a burner assembly comprising annular wall means on which the heat generating means is mounted for focusing heat emitted therefrom internally within the combustion chamber, a bed support connected to the annular wall means and rotatable therewith in spaced relation to the infeed passage means and impeller means mounted on the bed support for impelling the combustible material onto the heat generating means.

20. The rotor assembly as defined in claim 19 including bladed blower means connected to the annular wall means for inducing exhaust flow from the combustion chamber in counter-current relation to the combustible material conducted through the infeed passage means.

21. The smoke generating apparatus as defined in claim 20 including means for axially displacing the infeed passage means between loading and smoke generating positions, sealing means mounted on the infeed passage means for preventing infeed of the material into the combustion chamber in the smoke generating position of the infeed passage means and means responsive to said displacement of the infeed passage means to the loading position for blocking said exhaust from the combustion chamber induced by the blower means during rotation of the burner assembly.

22. The apparatus as defined in claim 21 including means mounted in the burner assembly for dispersal of said material deposited therein for response to rotation of the burner assembly.

23. The apparatus as defined in claim 22 including means mounted in the infeed passage means in operative relation to the dispersal means in the smoke generating position of the infeed passage means for comminuting the material prior to entry into the combustion chamber.

24. The burner assembly as defined in claim 20 including power transmitting means connected to the bed support for imparting rotation to the annular wall means and supplying energy to the heat generating means during said rotation of the burner assembly.

25. The burner assembly as defined in claim 19 including power transmitting means connected to the bed support for imparting rotation to the annular wall means and supplying energy to the heat generating means during said rotation of the burner assembly.

26. The apparatus as defined in claim 19 including a hopper chamber enclosed by the housing above the infeed passage means within which the combustible material is stored, and duct means mounted on the housing in heat conductive relation to the hopper chamber for discharge of the smoke from the blower means.

27. In a smoke generating apparatus including a housing having a combustion chamber therein, infeed passage means for conducting combustible material into the combustion chamber and heat generating means for combustion of the material within the combustion chamber, the improvement residing in a burner assembly comprising a rotatable rotor enclosing the combustion chamber into which the material is deposited by the infeed passage means, blower means connected to the rotor for inducing exhaust flow therefrom in response to rotation of the rotor, means for axially displacing the infeed passage means between loading and smoke generating positions, sealing means mounted on the infeed passage means for preventing infeed of the material into the combustion chamber in the smoke generating position of the infeed passage means and means responsive to said displacement of the infeed passage means to the loading position for blocking said exhaust from the combustion chamber induced by the blower means during rotation of the rotor.

28. The improvement as defined in claim 27 including means mounted in the rotor for dispersal of said material deposited therein in response to said rotation of the rotor.

29. The improvement as defined in claim 28 including means mounted in the infeed passage means in operative relation to the dispersal means in the smoke generating position of the infeed passage means for comminuting the material prior to entry into the combustion chamber.

30. The improvement as defined in claim 27, including means for indicating said displacement of the infeed passage means to the loading position.

31. In a combustion apparatus, a rotor enclosing a combustion zone, heating means mounted in operative relation to the combustion zone for combustion of material therein and drive means for imparting rotation to the rotor and the heating means during combustion of the material within the combustion zone.

32. The apparatus of claim 31 wherein said rotor includes an annular wall having opposite axial ends and a bed support fixed to the annular wall at one of the axial ends on which said material is received.

33. The apparatus as defined in claim 32 including passage means at the other of the axial ends of the annular wall for conducting infeed of the material to the combustion zone and exhaust of combustion products therefrom.

34. The apparatus of claim 33 wherein the heating means is mounted on the annular wall internally of the combustion zone.

35. The apparatus of claim 32 wherein the heating means is mounted on the annular wall internally of the combustion zone.

* * * * *